US008020687B2

(12) United States Patent
Sutherland

(10) Patent No.: US 8,020,687 B2
(45) Date of Patent: Sep. 20, 2011

(54) ENHANCEMENT METHOD AND APPARATUS FOR ESCALATOR OR MOVING WALKWAY

(76) Inventor: Rex John Sutherland, Victoria (AU)

( * ) Notice: Subject to any disclaimer, the term of this patent is extended or adjusted under 35 U.S.C. 154(b) by 393 days.

(21) Appl. No.: 12/327,141

(22) Filed: Dec. 3, 2008

(65) Prior Publication Data

US 2010/0136243 A1 Jun. 3, 2010

(51) Int. Cl.
*B66B 29/08* (2006.01)

(52) U.S. Cl. ..... 198/325; 198/326

(58) Field of Classification Search ..... 198/325, 198/326, 333, 493, 494, 495
See application file for complete search history.

(56) References Cited

U.S. PATENT DOCUMENTS

| | | | | |
|---|---|---|---|---|
| 3,678,533 | A * | 7/1972 | Cravits | 15/302 |
| 4,514,872 | A * | 5/1985 | Hopkins | 198/496 |
| 4,664,719 | A | 5/1987 | Mizutani | |
| 4,709,441 | A * | 12/1987 | Center | 15/301 |
| 5,025,527 | A | 6/1991 | Armstrong | |
| 5,117,968 | A * | 6/1992 | Rivera | 198/494 |
| 5,997,644 | A | 12/1999 | Zickell | |
| 6,398,002 | B1 * | 6/2002 | Choquette et al. | 198/325 |
| 7,232,028 | B2 * | 6/2007 | Schulz | 198/493 |
| 2003/0021623 | A1 | 1/2003 | Harper | |

FOREIGN PATENT DOCUMENTS

| | | |
|---|---|---|
| AU | 199965341 A1 | 6/2000 |
| DE | 4436551 C1 | 12/1995 |
| FR | 2425277 | 12/1979 |
| JP | 11333371 | 12/1999 |
| JP | 2002046969 | 2/2002 |
| JP | 2005022798 | 1/2005 |

OTHER PUBLICATIONS

Australian Patent Office, International Search Report for International Application No. PCT/AU2009/001581, mailed Jan. 28, 2010, Authorized Officer: Allan Smailes.

* cited by examiner

*Primary Examiner* — James R Bidwell
(74) *Attorney, Agent, or Firm* — Stites & Harbison PLLC; Douglas E. Jackson

(57) ABSTRACT

An apparatus is used to enhance the standing-surfaces of platform-components of an escalator or a moving walkway which moves in a continuous loop. The apparatus is maintained in a constant position relative to the moving parts of the escalator or walkway such that, while in that constant position, all the standing-surfaces continually pass under the apparatus as a result of the continuous loop of the escalator. When the escalator is in operation, an applicator-means of the apparatus applies a flowable enhancement-material, in situ, to the standing-surfaces of the moving platform-components. The material solidifies thereon to enhance the surface characteristics of the standing-surfaces of the escalator, or moving walkway as the case may be.

16 Claims, 11 Drawing Sheets

ANGLE "A" SHOULD BE 50 DEGREES AND WILL BE CORRECTED WITH A REPLACEMENT FORMAL DRAWING

ENHANCEMENT METHOD AND APPARATUS FOR ESCALATOR OR MOVING WALKWAY

FIELD OF INVENTION

The present invention relates exclusively to escalators and moving walkways (travelators), and relates particularly to a method and apparatus used to enhance standing-surfaces on existing escalators or moving walkways.

BACKGROUND OF THE INVENTION

Escalators are mechanized, moving stairs. These mechanisms include a plurality of platform-components that are connected in an endless loop. The platform-components are arranged to circulated so as to resemble moving stairs. People stand on the platform-components, and thus are transported either up or down the moving stairs by the movement of the platform-components. Prior Art FIG. 1 shows an illustration of part of a conventional escalator.

Another variety of such mechanisms are moving walkways which are based on a similar concept, except that the platform-components are arranged to resemble moving, elongated platforms which are actually made up of a loop of connected the platform-components. These moving walkways are also known as travelators.

When such escalators and moving walkways are used, the people stand on the upper surfaces (tread plate) on the platform-components, and hence, the upper surfaces on which people stand, during such use, will be referred to in this specification as standing-surfaces of the platform-components.

Prior art FIG. 2 shows a conventional platform-component 20 which has an alternating series of elongate, parallel valleys and peaks that, in operation, generally align axially with the travel direction of the platform-components.

Over the last few decades, many thousands of such escalators and moving walkways have been installed in various locations, such as in office buildings, shopping centers, airports, for example, however, over a period of time, it has become necessary to enhance the standing-surfaces of those existing escalators.

For example, the standing-surfaces of escalators may need to be enhanced to address the issue of the standing-surfaces tending to become slippery, particularly during rainy periods when the soles of the users' shoes are wet.

Also, the standing surfaces of newly-installed escalators and moving walkways may need to be enhanced to address the issue of the standing-surfaces becoming slippery.

A known solution to this problem of the standing-surfaces being able to become slippery, particularly when wet and/or soiled, is for the manufacturer of the escalator to enhance the surface of the standing-surfaces by arc-spraying a material onto the standing-surfaces. The resulting surface has a sandpaper-like characteristic. This provides the standing-surfaces with greater friction which is intended to minimize the likelihood of users slipping on the standing-surfaces, particularly during wet weather.

Another known solution to this problem is for the manufacturer to provide cuts or abrasions to the surface of the standing-surfaces. This, once again, is intended to provide the standing-surfaces of the escalator with greater friction in order to minimize the likelihood of slippage by the users particularly when the standing-surfaces become wet and/or soiled.

There are, however, several disadvantages inherent in the above approaches, as follows:

There is considerable expense involved in disassembling an escalator or walkway so that the individual platform-components can be taken away to the manufacturer's off-site facility for repair enhancement.

The known enhancement methods, such as arc-spaying or physical cutting of the surfaces, are expensive.

Moreover, during the time period when the escalator is shut down, there is considerable inconvenience caused. For example, the closure of an escalator in a shopping centre can cause severe disruption to shoppers trying to move around the shopping centre. Also, when individual platform-components are removed from an escalator to be taken away for enhancement at the manufacturer's facility, the resulting gap in the escalator structure means that people cannot even walk up and down the motionless escalator.

Furthermore, it can sometimes take a week or two, for example, for platform-components to be enhancement off-site, which means that the abovementioned inconvenience can be exacerbated by the length of time often needed to restore the escalator to operation.

Another situation where the standing-surfaces of an escalator or moving walkway has to be enhanced is where one or more of the peaks become damaged. For example, if a hard object such as a wedding ring, screw, coin, stone or piece of metal were to be dropped onto a standing-surface, it would be carried along on the standing-surface until it reaches the end of the exposed moving portion of the escalator, ending at a location 16 where the standing-surfaces move under a comb plate and under the ground surface 9 portion, shown in FIG. 1. The hard object could become lodged at that location 16 where the moving standing-surfaces meet the stationary comb plate. At this location 16, the hard object can continue to scour or abrade the standing-surfaces as these move past continuously. In these situations, the damage would tend to be restricted to a localized area on the standing-surface, typically affecting either one or two peaks. Such localized damage still requires disassembling the escalator so that the individual platform-components can be taken away to the manufacturer's facility for repair enhancement.

Discussion of prior art herein, either individually or in combination, is not to be taken as an admission of common general knowledge of the skilled addressee of this specification.

An object of the present invention is to overcome or at least ameliorate one or more of the problems in the prior art, or to provide an improved alternative.

SUMMARY OF THE INVENTION

According to the present invention, there is provided a method of enhancing standing-surfaces of platform-components of an escalator or a moving walkway which, in operation, is able to move in a continuous loop of a plurality of mutually connected platform-components, and in which the standing-surface of each platform-component has an alternating series of elongate, parallel valleys and peaks that generally align axially with the travel direction of the platform-components, the method comprising:

using position-maintenance-means of an enhancement apparatus to maintain the enhancement apparatus in a constant position relative to the escalator or moving walkway such that all the standing-surfaces of the platform-components are able to pass under the enhancement apparatus one followed by another as a result of movement of the continuous loop of the mutually connected platform-components; and using applicator-means of the enhancement apparatus, when the escalator or moving walkway is in operation in situ, to apply a flowable enhancement-material to one or more peaks of the standing-surfaces of the moving platform-components at which location on the one or more peaks the flowable enhancement-material solidifies in order to enhance surface characteristics of the peaks of the standing-surfaces.

Preferably, the method includes: using the applicator-means to feed the flowable enhancement-material onto a rotatable applicator when the applicator is rolling, so that at least a part of the applicator is coated with the enhancement-material; and, while the escalator or moving walkway is in operation, allowing the rotatable applicator to roll on the standing-surfaces as the standing-surfaces pass under the enhancement apparatus one followed by another, such that the flowable enhancement-material on the rotatable applicator is applied by transference to the one or more peaks.

Preferably, the method includes:

feeding the flowable enhancement-material into a collection receptacle having outlet-means which leads onto the rotatable applicator.

Preferably, the flowable enhancement-material comprises an epoxy resin.

Preferably, the epoxy resin is based on Bisphenol A.

Preferably, the epoxy resin uses a solidifier based on Benzyl Alchol, Diethylenetriamine, Cycloaliphatic Amine Mixture, Isophorone Diamine and 4,4'-Isoproplylidenediphenol.

Preferably, the flowable enhancement-material includes a particulate material that is able to provide slip-resistance.

The particulate material may contain metallic, synthetic or mineral-based particles.

The particulate material may include Aluminum particles, or an Based-based particulate material, or quartz particles, or polypropylene particles.

According to another aspect of the present invention, there is provided an enhancement apparatus adapted to enhance standing-surfaces of platform-components of an escalator or a moving walkway which, in operation, is able to move in a continuous loop of a plurality of mutually connected platform-components, and in which the standing-surface of each platform-component has an alternating series of elongate, parallel valleys and peaks that generally align axially with the travel direction of the platform-components, wherein the apparatus comprises:

position-maintenance-means adapted to maintain the enhancement apparatus in a constant position relative to the escalator or moving walkway such that, in use, all the standing-surfaces of the platform-components are able to pass under the enhancement apparatus one followed by another as a result of movement of the continuous loop of the mutually connected platform-components; and applicator-means adapted to apply a flowable enhancement-material, when the escalator or moving walkway is in operation in situ, to one or more peaks of the standing-surfaces of the moving platform-components at which location on the one or more peaks the flowable enhancement-material solidifies in order to enhance surface characteristics of the peaks of the standing-surfaces.

Preferably, the applicator-means comprises a rotatable applicator which is adapted to receive the flowable enhancement-material thereon when rolling so that at least a part of the applicator is coated with the material;

and which rotatable applicator is arranged to roll on the standing-surfaces as the standing-surfaces pass under the enhancement apparatus one followed by another, when the escalator or moving walkway is in operation, such that the flowable enhancement-material on the rotatable applicator is applied by transference to the one or more peaks.

Preferably, the rotatable applicator comprises a wheel-like portion that has an outer rolling-surface which is adapted to receive the flowable enhancement-material thereon, and wherein the wheel-like portion has a width which, when rolling on the standing-surfaces of a platform-component, is able to extend across one or more peaks.

Preferably, the applicator-means is adapted to apply the flowable enhancement-material, when the escalator or moving walkway is in operation in situ, to a plurality of the peaks of the standing-surfaces, and wherein the enhancement apparatus includes applicator-direction-adjustment-means that allows adjustment of rolling direction of the rotatable applicator with respect to the travel direction of the platform-components, when the escalator or moving walkway is in operation, and wherein the applicator-direction-adjustment-means allows adjustment to enable the rotatable applicator to be arranged so that its facing-direction is at a slight angle with respect to the travel direction of the platform-components to enable the rotatable applicator to move laterally while at the same time rolling on the standing-surfaces.

Preferably, the applicator-means includes material-transfer-variation-means that enables the rate or amount of transference of the flowable enhancement-material by the applicator-means to be selectively varied.

Preferably, the material-transfer-variation-means includes a collection receptacle which is adapted to receive the flowable enhancement-material therein, and which includes outlet-means through which an amount of the flowable enhancement-material in the collection receptacle is able to flow therefrom to the peaks via the rotatable applicator.

Preferably, the outlet-means is provided with variable-outlet-means to allow adjustment of the amount of the flowable enhancement-material that flows from the receptacle onto the rotatable applicator.

DRAWINGS

In order that the present invention might be more fully understood, embodiments of the invention will be described, by way of example only, with reference to the accompanying drawings, in which:

FIG. 1 relates to prior art, and is an illustration of part of a known escalator;

FIG. 2 relates to prior art, and is a perspective view of part of a standing-surface on a platform-component of a known escalator, such as shown in FIG. 1;

FIG. 3 relates to prior art, and is a schematic diagram that represents a cross-sectional front view of a standing-surface of a known platform-component;

In the embodiments, like components may be labeled with like reference numerals merely for the sake of ease of understanding the different embodiments and modifications.

Embodiments of the invention will be described in relation to escalators for the sake of illustration, however, other embodiments or modifications can be applied equally to moving walkways or travelators.

DESCRIPTION OF EMBODIMENTS

Figure 1:
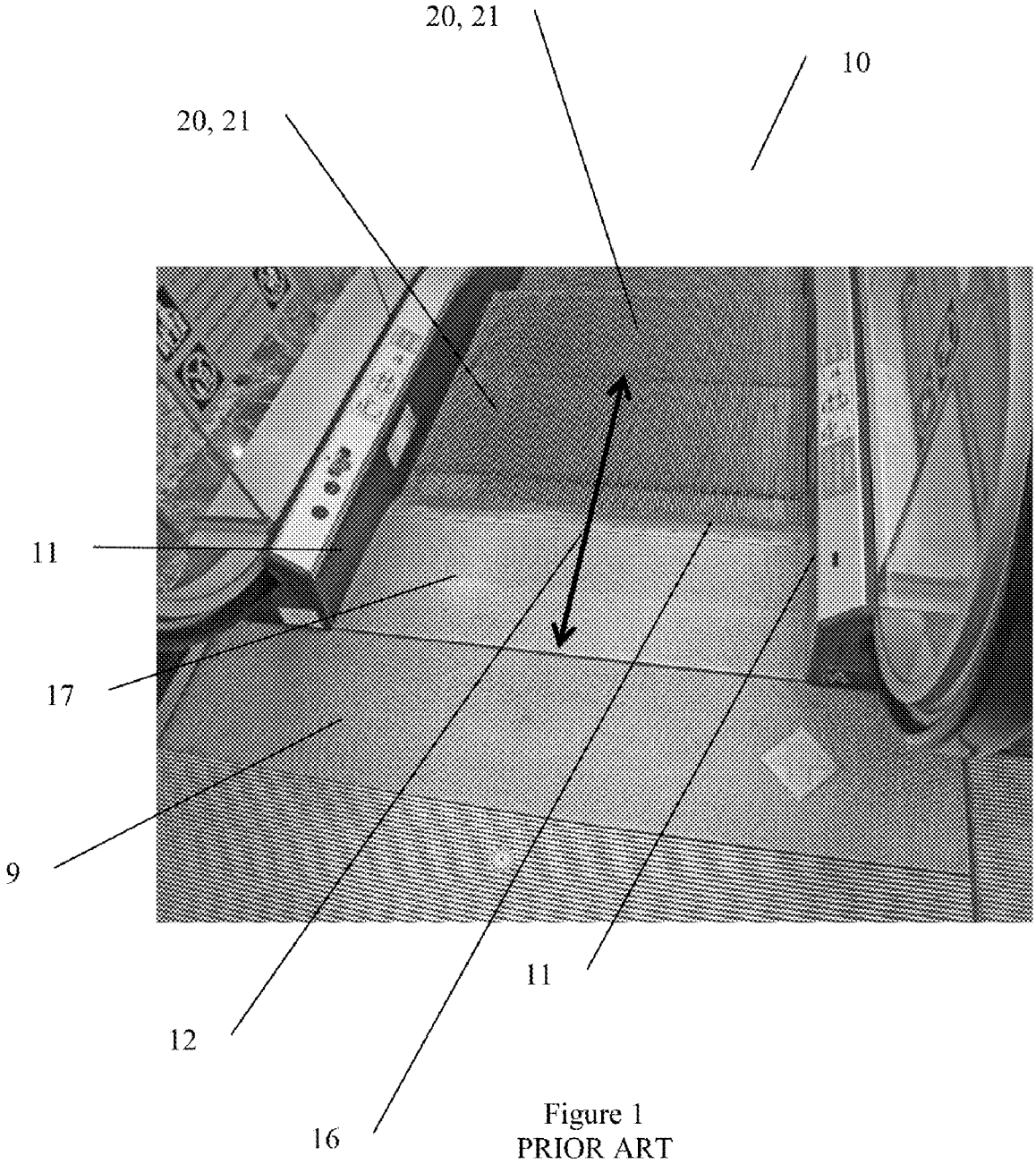
Figure 1 PRIOR ART

Referring to the accompanying drawings, FIG. 1 is an illustration of a conventional escalator 10.

In prior art FIG. 1, the escalator 10 includes a mutually-connected loop of platform-components 20. The platform-components 20 are able to move in a continuous loop during operation.

In FIG. 1, users stand on top of the platform-components 20. In FIG. 1, the uppermost, flat part 21 of each platform-component 20 acts as standing-surface on which the users can stand. The standing-surfaces are the form of tread-plates 21. The users stand on the tread-plates 21 and are thereby conveyed by the escalator, thus avoiding having to climb up or down the stairs.

In FIG. 1, the moving tread-plates 21 are bordered on either side by upright side-panels 11 which may be vertical or at a slight incline.

Figure 2:
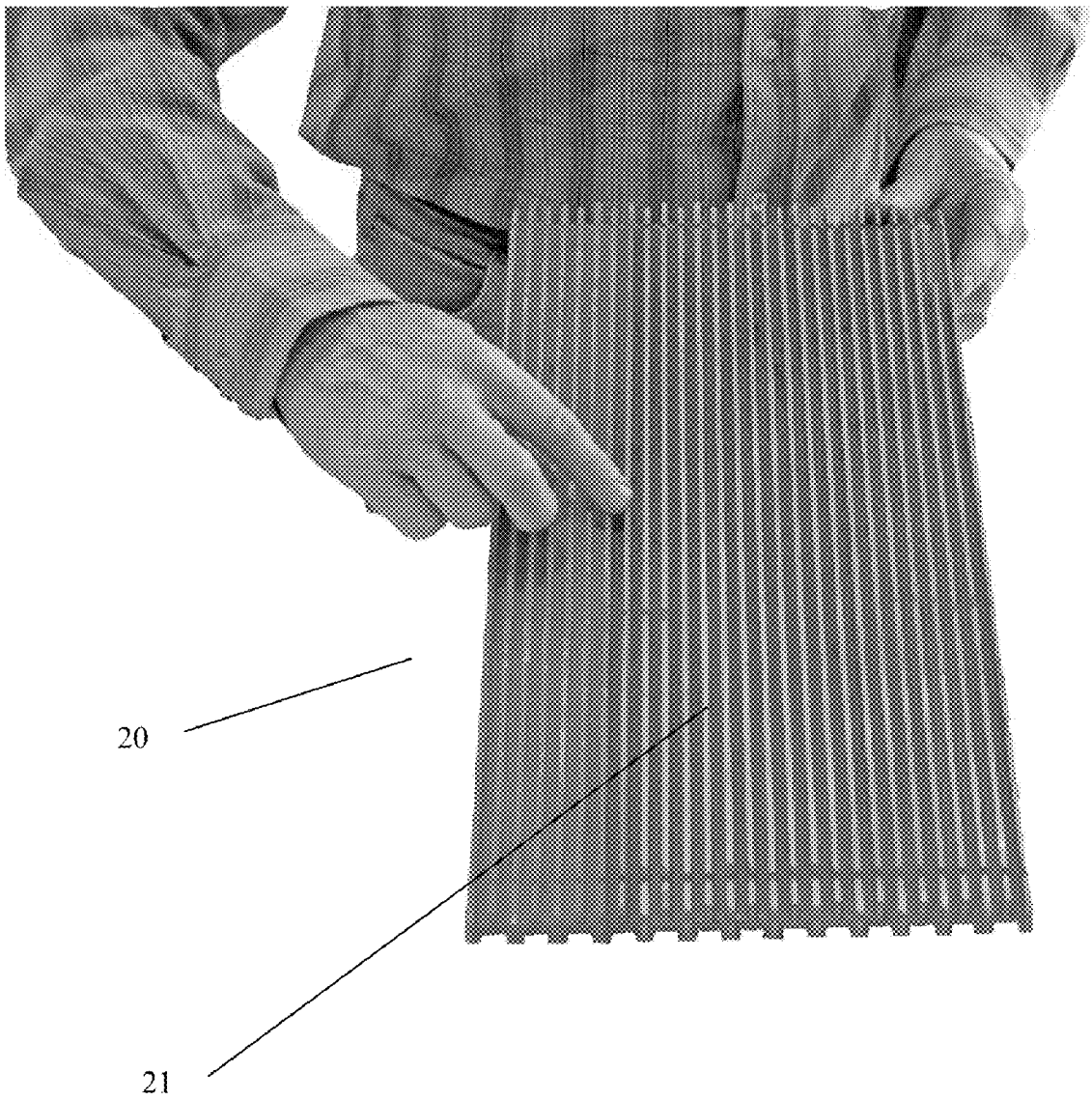
Figure 2 PRIOR ART
Figure 3:
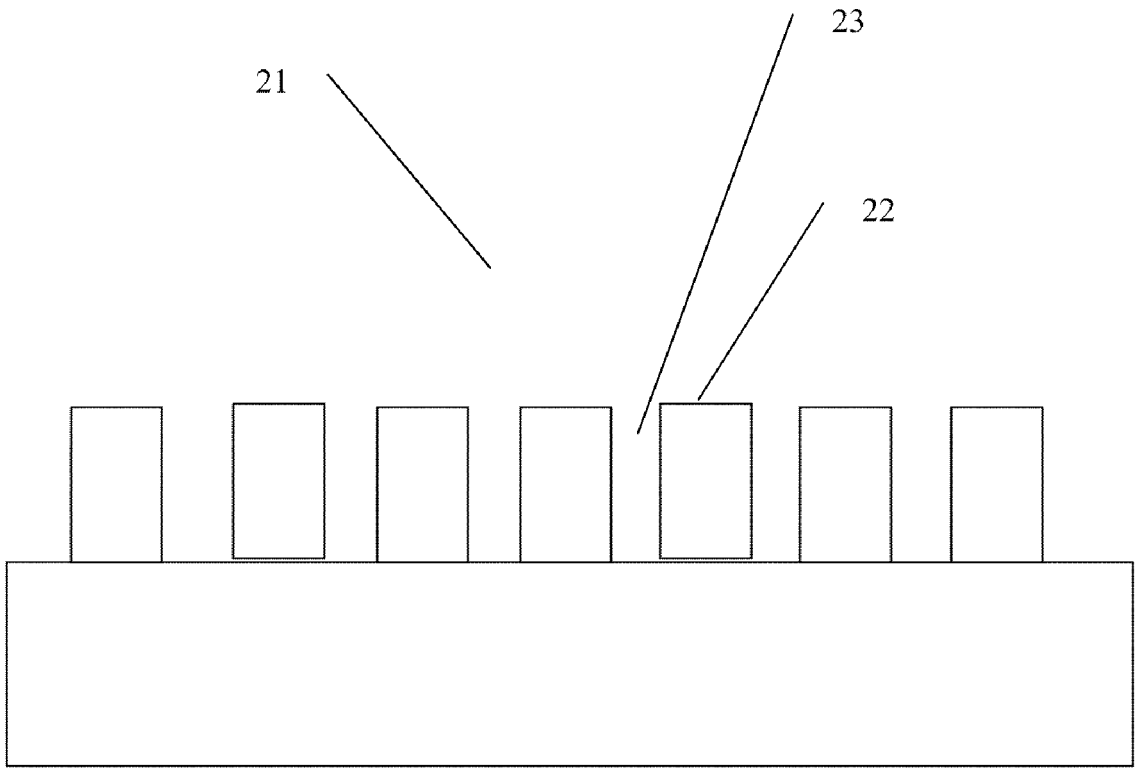
Figure 3 PRIOR ART

FIG. 2 shows a perspective view of a tread-plate 21 of a conventional platform-component 20. The tread-plate 21 has an alternating series of elongate, parallel valleys and peaks that, in operation, generally align axially with the travel direction of the platform-components. In terms of appearance, the peaks 22 separated by valleys 23, in FIG. 3, are in the form that resembles rows of parallel ribs.

In conventional escalators, the tops of the peaks can be curved, flat, peaked, cut or serrated, however, embodiments of the invention are able to enhance peaks with all of these surface variations.

In FIG. 1, the travel direction A-A of the escalator is shown with an arrow 12 which indicates that the escalator is able to act as a moving stairway that has its tread-plates 21 moving either upwards or downwards in order to convey the users either up or down the stairway.

Material Dispenser

Figure 4:
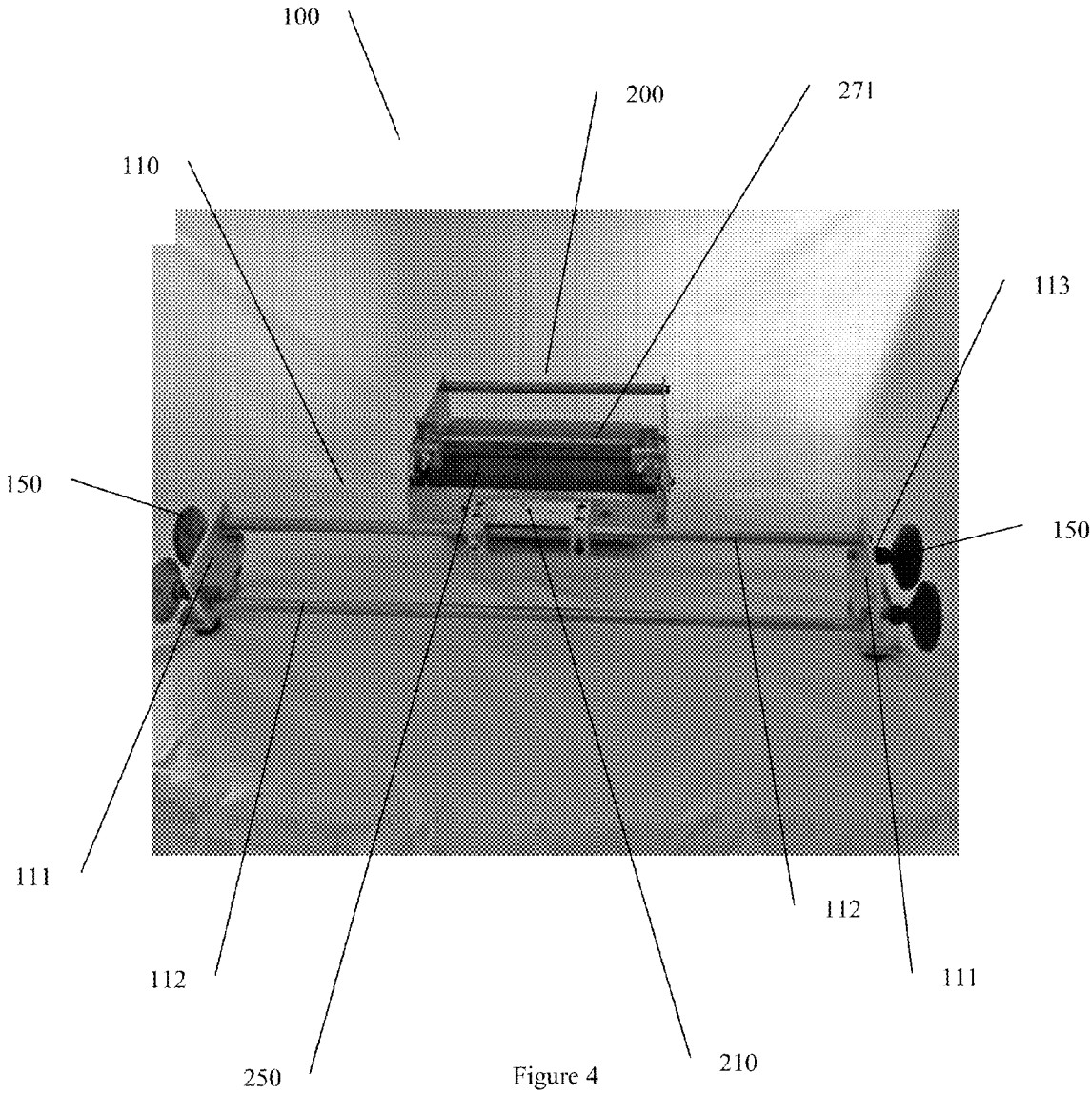
FIG. 4 shows a front-on perspective view of an enhancement apparatus in the form of a material dispenser according to a first embodiment of the present invention.
Figure 5:
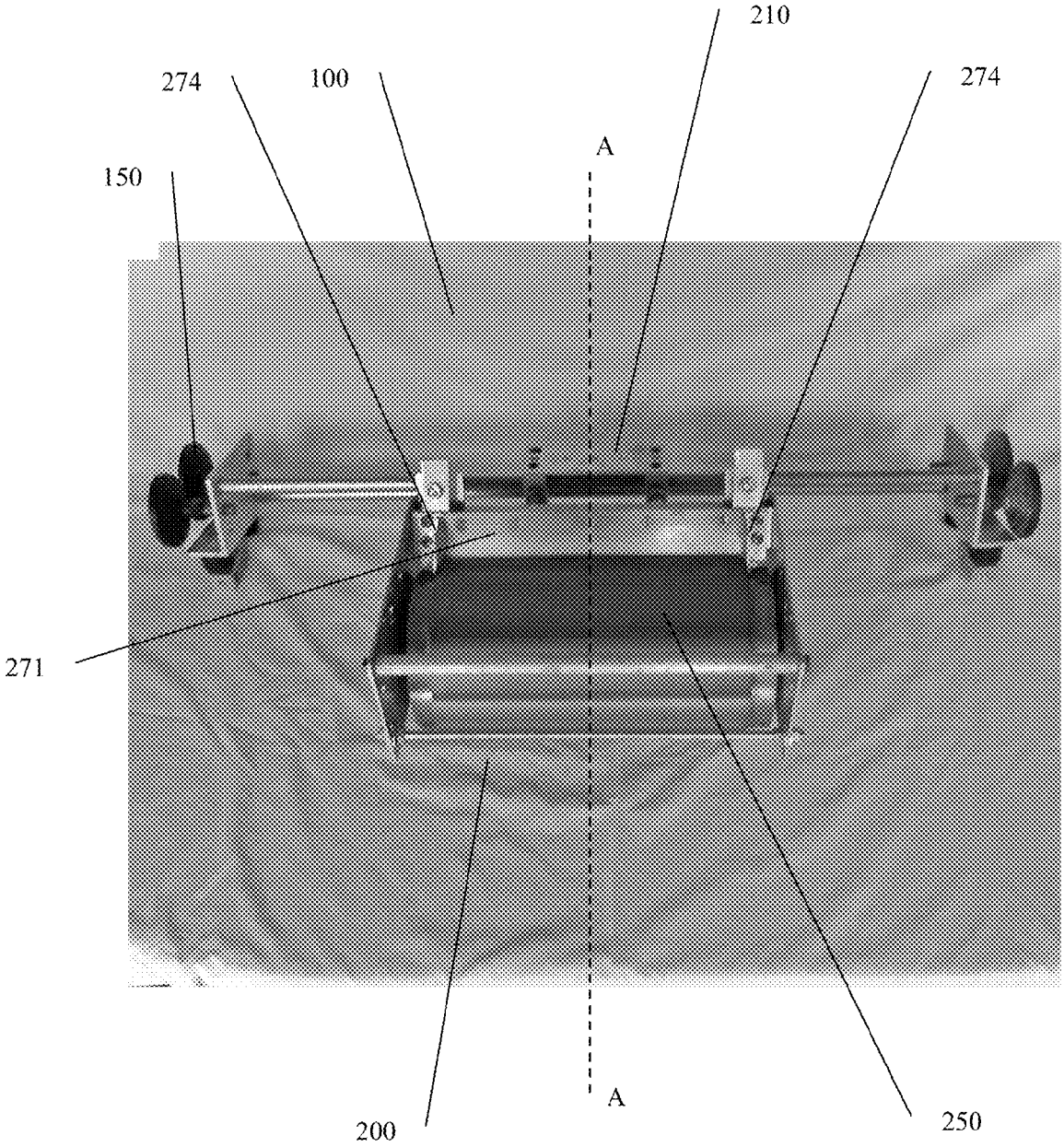
FIG. 5 shows another front-on perspective view of the first embodiment of FIG. 4, seen from its other side.
Figure 6:
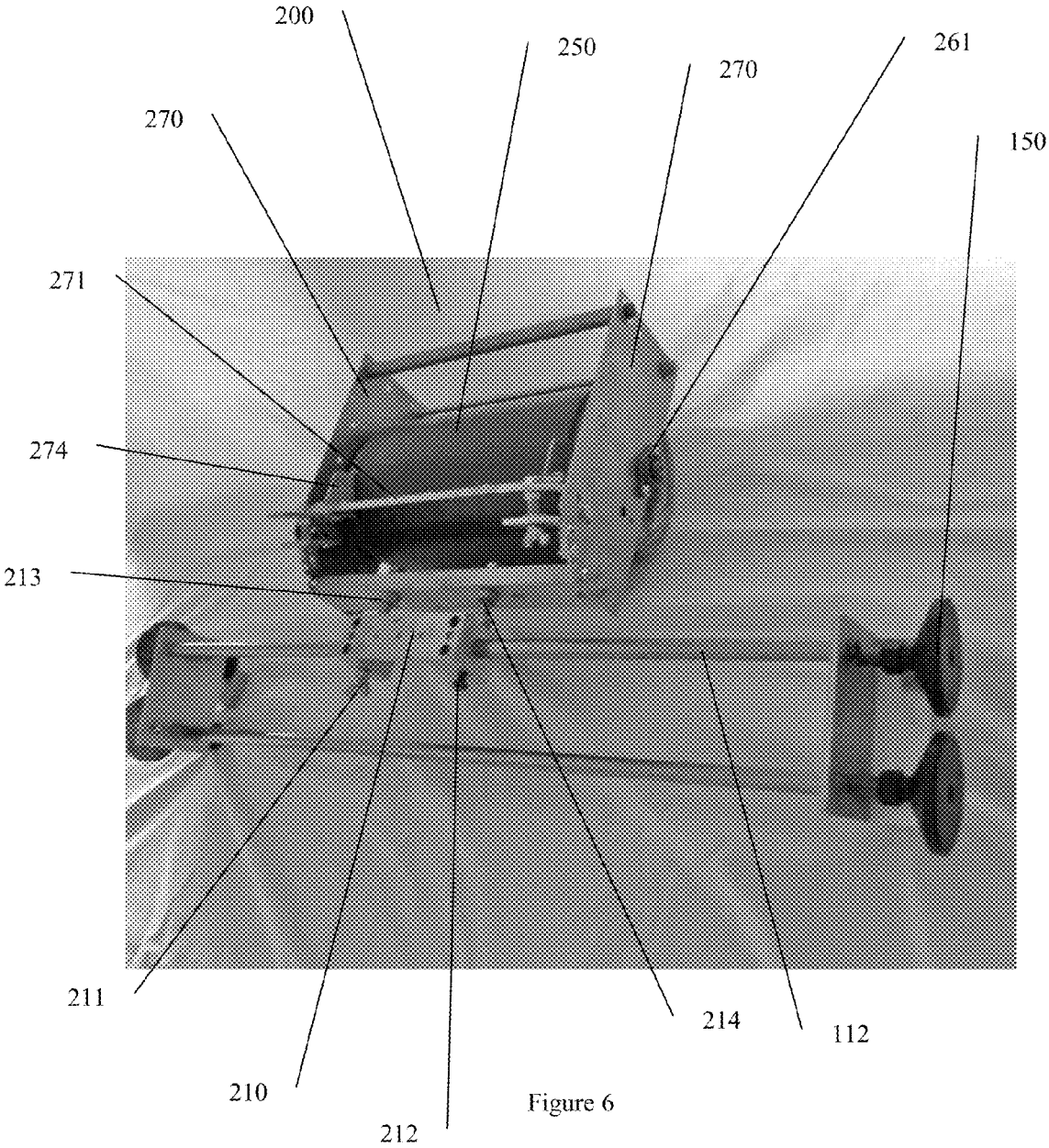
FIG. 6 is a side perspective view of the first embodiment of FIGS. 4 and 5.

FIGS. 4, 5 and 6 show various views of a first embodiment of an enhancement apparatus, in the form of a material dispenser 100 that is adapted to enhance the tread-plates 21 of platform-components 20, in the sense of enhancing the surfaces of the peaks of the tread-plates.

As an overview, the material dispenser 100 is positioned and maintained in a constant position between the side-panels 11 that are on either side of the moving tread-plates 21. Thus, when the escalator is in operation, in situ, a continuous procession of tread-plates 21 moves underneath the dispenser 100 which is kept in a constant location.

The dispenser 100 is provided with applicator-means that is adapted to apply a flowable enhancement-material 300 to one or more peaks of the tread-plate of the moving platform-components. The flowable enhancement-material 300 solidifies on the peaks, thereby enhancing the surface characteristics of the peaks of the tread-plates.

In the embodiment, the material dispenser 100 has a support frame 110 which includes two end-panels 111 that are supported at either end of a pair of struts 112.

A critically important feature of the invention and all its embodiments is that it is able to enhance the surfaces of parts of an escalator or moving walkway while it is in operation in situ, and thus avoids the expense and/or inconvenience of shutting down and disassembling the escalator or moving walkway for relocation of those parts for off-site enhancement.

Position Maintenance

In FIGS. 4, 5 and 6, the material dispenser 100 is provided with position-maintenance-means in a form which includes swivel-pads 150.

In operation, the platform-components of the escalator are in continuous movement, hence, the position-maintenance-means is able to hold fast the material dispenser 100 to an object that is not moving, relative to the moving platform-components, in order that the overall material dispenser 100 is maintained in a constant position relative to the moving platform-components. In the embodiment, the frame of the material dispenser 100 is held firmly between the non-moving, upright side-panels 11, seen in FIG. 1.

The swivel-pads 150 have threaded stems 113 which screw into holes in the end-panels 111. Screwing the stem 113, either inwards or outwards, allows the swivel-pad 150 to be positioned either closer or further away from its respective end-panel 111 of the frame.

The swivel-pad 150 are connected to its stem 113 by a ball-and-socket mechanism that allows the pad 150 to swivel at the end of the stem 113, and to have a restricted degree of freedom. In the range of different escalators, the angle of orientation of the side-panels 11 can vary, hence, the slight degree of freedom of the swivel-pads 150 allows the material dispenser 100 to be used with a wide variety of side-panel 11 which can vary in their angles of inclination or configurations as can be found in existing escalator or walkways.

In operational use of the embodiment, the material dispenser 100 is positioned in between the upright side-panels 11 of the escalator. Both of the swivel-pads 150, at either side of the material dispenser 100, are rotated so as to move outwardly until each of the pads 150 press against the side-panels 11 of the escalator, thus bracing the support frame 110 of the material dispenser 100 therebetween. The support frame 110 of the material dispenser 100 is thus able to be maintained in this constant position, until it is later removed by loosening the pads 150.

The swivel-pads 150 maintain the support frame 110 of the material dispenser 100 in a constant location relative to the moving parts of the escalator or moving walkway.

In use, all the tread-plates of the platform-components are able to pass under the support frame 110 of the material dispenser 100, one followed by another, as a result of movement of the continuous loop of the mutually connected platform-components of the escalator. (Even if the frame 110 were to be positioned above the flat surface 17 of the cone plate, the fact remains, by definition, that all the tread-plates still pass under the frame 110).

In the embodiment, the position-maintenance-means enables the material dispenser 100 to be fitted to a wide range of known escalators or moving walkways, particularly at their points of entry or exit. The operator would stand on the ground surface 9 that is adjacent to the entry or exit of the escalator.

Applicator

FIGS. 4, 5 and 6 show various views of the first embodiment in which the material dispenser 100 includes applicator-means in the form of a material-applicator 200.

The material-applicator 200 is attached to a traveling-component in the form of a saddle 210. The saddle 210 is attached to one of the struts 112 of the support frame 110. In use, the frame 110 is held between the side-panels 11 of the escalator. Thus, in this arrangement, the material-applicator 200 is able to sit on the tread-plates 21 of the platform-components 20 of the escalator.

In operational use, the swivel-pads 150 hold the struts 112 of the material dispenser 100 in a constant position relative to the moving parts of the escalator, wedged between the upright side-panels 11 of the escalator.

Thus, the overall material dispenser 100 is maintained in a constant position relative to the moving parts of the escalator or moving walkway, even though, in this constant position, various components of the material dispenser 100 itself can be in motion.

The material-applicator 200 has a rotatable applicator in a form which includes an applicator-wheel 250. In use, the applicator-wheel 250 sits on top of the tread-plates 21.

In use, all the tread-plates are able to pass under the support frame 110 of the material dispenser 100, one followed by another, as a result of movement of the continuous loop of the mutually connected platform-components. As a result, the applicator-wheel 250 is able to roll on top of the tread-plates as these sequentially pass under the material dispenser 100 one after the other.

When the escalator or moving walkway is in operation, the support frame 110 of the material-applicator 200 is held in constant position relative to the escalator by the swivel-pads 150, however, the applicator-wheel 250 of the applicator 200 is able to roll on the tread-plates 21 as the continuous loop of tread-plates passes under the material dispenser 100, one tread-plate followed by another tread-plate in a continuous cycle.

The reference to "constant position" means that the overall material dispenser 100 remains in the same position, with its frame held fast between the side-panels 11 by the swivel-pads 150. While the frame of the material dispenser 100 is held in this constant position, various components of the mechanism in the material dispenser 100 are operable, as described herein.

In FIG. 6, the saddle 210 is provided with holes, through which the strut 112 passes through, thus enabling the saddle 210 to slide side to side along the length of the strut 112 on which it is so attached. Thus, the saddle 210 is able to move left or right along the strut 112, and can be fixed in a selected location on the strut using locking wing bolts 211, 212.

Furthermore, the saddle 210 is able to pivot about the strut 112 on which it is mounted. This ability to pivot enables the material-applicator 200 and its applicator-wheel 250 to likewise have a degree of pivotal motion around the strut 112.

In operation, the applicator-wheel 250 of the material-applicator 200 rolls on top of the tread-plates 21 of the escalator. In practice, the tread-plates 21 can have minor surface irregularities or unevenness. It is found that existing tread-plate surfaces 21 may not be uniformly even, particularly from one platform component 20 to the next 20. Therefore, the ability of the saddle 210 to pivot about its strut 112 means that the applicator-wheel 250, of the applicator 200, is able to ride up or down in response to minor surface irregularities or unevenness found in the tread-plates. Therefore, as the material-applicator 200 rolls on the tread-plates 21, there is a greater likelihood that the applicator-wheel 250 will be able to continuously touch every part of the peaks over which it rolls.

Application of Material To The Peaks

As described above, the tread-plate 21 of a conventional platform-component 20 has an alternating series of elongate, parallel valleys and peaks. It is the tops of the peaks to which the enhancement-material is intended to be applied by the overall material dispenser 100. In existing escalators or moving walkways, the tops of the peaks can be curved, flat or provided with cuts in the upper surface, hence, the invention is not limited to enhancing peaks of any one shape or configuration.

Figure 7:
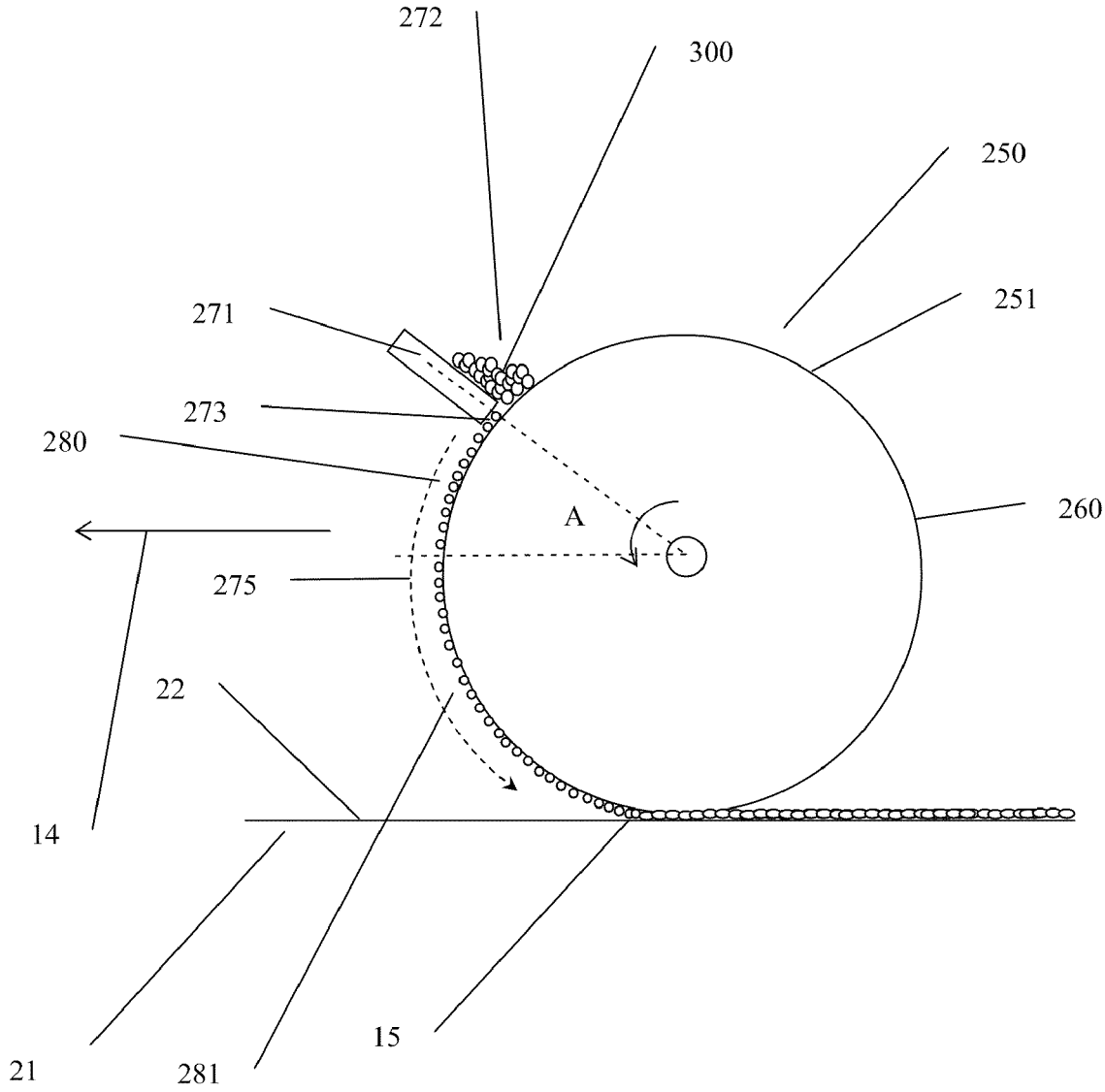
FIG. 7 is a schematic cross-sectional side view of the first embodiment of FIGS. 4, 5 and 6 viewed along the line A-A of FIG. 5 (in the diagram of FIG. 7, the material is represented schematically as small circles merely for the sake of illustration)

Referring to FIG. 7, an enhancement-material 300, initially in flowable form, is applied to the surface of the applicator-wheel 250. This application of the flowable material is performed, in situ, while the applicator-wheel 250 rolls on top of the moving tread-plates 21 while the escalator is in operational motion.

During the process, all or at least part of the applicator-wheel 250 becomes coated with the enhancement-material. Thereafter, the flowable enhancement-material, that is on the applicator-wheel 250, is subsequently applied by transference, from the applicator-wheel 250, to the peaks 22 of the tread-plates 21 of the escalator.

The flowable enhancement-material is transferred to one or more peaks 22 of the tread-plates 21. At this location on the one or more peaks, the flowable enhancement-material eventually solidifies in order to enhance surface characteristics of the peaks.

The applicator-wheel 250 has a wheel-like portion that has an outer rolling-surface which is adapted to receive the flowable enhancement-material thereon. In the embodiment of FIGS. 4, 5 and 6, the wheel-like portion is shaped as an elongate cylinder 251.

The cylinder 251 of the applicator-wheel 250 is supported on an axle 260. Each end 261 of the axle 260 is attached to a body-frame 270 of the material-applicator 200.

The wheel-like portion of the applicator-wheel 250 has a width which, when rolling on the tread-plates 21 of a platform-component 20, is able to extend across several peaks. In the embodiment, the width is able to cover a few dozen peaks at one time.

In the embodiment of FIG. 4, however, the width of the applicator-wheel 250 does not take up the entire gap that is between the two side-panels 11 of FIG. 1. For example, in the embodiment, in the case of a one meter gap between the side-panels 11, the width of the applicator-wheel 250 would typically take up one third of that one meter gap. Hence, in this embodiment, several passes of the applicator-wheel 250 are needed to apply the material to the tread-plates 21.

In practice, there is often a margin of about 50 mm, parallel to and directly adjacent each of the side-panels 11 that does not receive the enhancement-material 300. In this margin, there is usually a yellow-colored demarcation line that indicates to the user the location of the boundary edge of the escalator stair.

In other modifications or variations, the width of the applicator-wheel 250 can be embodied so as to take up a greater or lesser percentage of the width between the side-panels 11, for instance, 80% or 90% or even more, as desired.

Transfer Variation

In the embodiment of FIGS. 4, 5 and 6, the material-applicator 200 is provided with material-transfer-variation-means that enables the user to selectively vary and control the rate or amount of transference of the flowable enhancement-material by the material-applicator 200 to the peaks.

In the embodiment, the material-transfer-variation-means includes a barrier blade 271.

FIG. 7 is a cross-sectional side view of the first embodiment viewed along the line A-A of FIG. 5. During operation of the enhancement process of the present embodiment, the rate or amount of flowable material, that transfers from the applicator-wheel 250, is influenced by the distance of the barrier blade 271 relative to the surface of the applicator-wheel 250.

When the barrier blade 271 is further away from the surface of the applicator-wheel 250, the larger gap therebetween enables more material 300 to end up on the peaks 22 of the tread-plates 21.

In contrast, when the barrier blade 271 is closer to the surface of the applicator-wheel 250, the smaller gap therebetween enables less material 300 to end up on the peaks 22 of the tread-plates 21.

In the embodiment of FIG. 7, the material-transfer-rate-variation-means is able to control the movement of material because it includes a collection receptacle 272 which is adapted to receive the flowable enhancement-material therein. In this specification, the reference to a receptacle refers either to an arrangement or to a space in which the flowable material is able to initially collect.

In other words, in the embodiment, the material 300 does not generally proceed immediately from the applicator-wheel 250 to the peaks 22 of the tread-plates 21. Instead, in the embodiment in FIG. 7, the flowable material 300 initially collects in the collection receptacle 272, and from there is subsequently allowed to be released from the receptacle 272 at a rate or amount that is selectively determined by the operator.

In FIG. 7, the space of the collection receptacle 272 is formed by an arrangement of the barrier blade 271 that extends across the length of the cylinder 251 of the applicator-wheel 250. In FIG. 7, the barrier blade 271 is arranged transverse to the surface of the cylinder 251 so as to form a space or region that acts as the collection receptacle 272. In FIG. 7, this receptacle region 272 is proximate the vertex of a triangular region that is between the blade 271 and the surface of the cylinder 251.

In FIGS. 5 and 6, slide-plates 274 are provided at each end of the collection receptacle 272. Thus, the blade 271, together with the two side-plates 274, combine to form boundaries of the collection receptacle 272.

In the embodiment of FIG. 7, the material-transfer-rate-variation-means also includes outlet-means through which an amount of the flowable enhancement-material 300 in the collection receptacle 272 is able to flow, from the receptacle, to the peaks 22, via the surface of the applicator-wheel 250. In FIG. 7, the outlet-means is formed as a gap 273 between the lower edge of the barrier blade 271 and the surface of the applicator-wheel 250.

The outlet-means is provided with variable-outlet-means to allow adjustment of the amount of the flowable enhancement-material that flows from the receptacle onto the rest of the rotatable applicator. In the embodiment, the variable-outlet-means is in the form of a mechanism that allows the gap 273 between the barrier blade 271 and the surface of the applicator-wheel 250 to be increased or decreased.

The operator is able to selectively vary and control the rate or amount of material 300 that passes through the gap 273 by either increasing or decreasing the distance between the barrier blade 271 and the surface of the applicator-wheel 250, which results in either an increase or decrease of the size of the gap 273 respectively.

In the embodiment, the angle of the blade 271, relative to the surface of the applicator-wheel 250, is generally perpendicular, however, slight variations can be tolerated, so long as the blade can perform the function of providing a gap 273 through which an amount of material 300, selected by the operator, is allowed to pass through to the surface of the roller that on the other side of the blade 271.

FIG. 7 shows that the material 300 from the collection receptacle 272, which passes through the gap 273, is subsequently conveyed, on the surface of the applicator-wheel 250, by the rolling motion of the applicator-wheel 250, eventually, at a point of contact 15, onto the surface of the peaks 22. (In FIG. 7, a dotted arrow 275 indicates the journey of the material 300, from the collection receptacle 272 to the surface of the peaks 22.)

FIG. 7 shows the barrier blade 271 positioned approximately between the vertical and the horizontal position. In FIG. 7, the angle A of the location of the barrier blade 271 (as opposed to the angle of the blade itself) is preferably 50 degrees relative to a horizontal axis, and preferably within a range of plus or minus 5 degrees, i.e. 45 to 55 degrees. An advantage of introducing the material 300 on the wheel at such a location, where the blade location is approximately 50 degrees relative to the horizontal, is that, even after the material 300 exits through the gap 273 and on past the blade 271, the material still has a few moments where it is located on an upwardly facing incline 280. This allows the material some time to consolidate its temporary adhesion to the surface of the wheel 250.

Whereas, if the material 300 were to be have been introduced onto the wheel 250 at a location too close to a vertical face of the wheel surface, then, when the material 300 exits past the blade 271, it would almost immediately be at a location 281 on the wheel 250 that is facing downwards, and the material 300, in such a location, may not have sufficient time to consolidate its temporary adhesion to the wheel 250, and thus could prematurely fall off the wheel before that portion of the wheel rotates to reach the point of contact 15 at the surface of the tread-plate 22.

Wheel Material

In the embodiment, the applicator wheel 250 is made from a wheel-material that is preferably a urethane material. Urethane is found to be more durable than rubber, and it is easier to clean off the material 300 from off the wheel 250 that is made from urethane.

In the embodiment, the urethane for the surface of the wheel-material preferably has a hardness of around 55 Shore-A, since the material 300 preferably contains aggregate particles which could more readily cut into the wheel-material if it were to be softer than 55 Shore-A.

In other embodiments, the range of hardness is preferably 55 Shore-A plus or minus 5 Shore-A. On one hand, if wheel-material is too soft, the wheel-surface can receive cuts from particulate and aggregate material in the flowable material 300. On the other hand, if the surface is too hard, then it may not have sufficient flexibility to resiliently conform to undulations on the surface of the peaks, which is something that is believed to assist in the application and transference of the material to the peaks.

Coating Thickness

In operation, the rate or amount of transference of material 300, from the applicator-wheel 250 to the peaks, will depend on the amount of the material 300 that is on the wheel 250 at the point of contact 15 with the peaks. Hence, the variable-outlet-means, the variable gap 273, enables the operator to control that factor to achieve the desired thickness of coating of the material 300 on the peaks 22.

Another factor that influences the rate or amount of transference of material 300 is the speed of the applicator-wheel 250 as it rolls on top of the surface of the peaks 22. In this respect, since the material dispenser 100 is maintained in a constant position relative to the moving parts of the escalator or moving walkway by the swivel-pads 150, it means that, in operation, the applicator-wheel 250 rotates at the same constant speed as that of the constant speed of the tread-plates of the escalator or moving walkway. The operational constant speed of the applicator-wheel 250 is an advantage because it allows a constant, even coating to be applied to the peaks. Such consistency would be more difficult to achieve if there was no ability to achieve a consistent speed of application of the material.

The operator can vary the size of the gap 273, depending on the speed that is imparted to the applicator-wheel 250 by the moving tread-plates. Alternatively, the operator may directly adjust the speed of the tread-plates to arrive at a balance of factors needed to achieve optimum coating.

The operator can use the applicator 200 to create a layer of adhesive on the tread-plates of preferably 0.50 mm to 2.00 mm in thickness. In the embodiment, such a layer of material is found to have acceptable tensile and compressive strength to the rib substrate of the tread plate.

The material dispenser 100 is able to achieve an application of material 300 to the peaks that is consistent in respect of coverage and profile.

Direction Adjustment

While the material dispenser 100 is in the process of applying the flowable material 300, its material-applicator 200 can either be locked into various positions along one of the struts 112, as selected by the operator, using the wing bolts 211, 212.

Alternatively, the operator can allow the material-applicator 200 to travel and reciprocate along one of the struts 112.

In order to allow the material-applicator 200 to change directions from right or left, in the embodiment in FIGS. 4, 5 and 6, the material dispenser 100 includes applicator-direction-adjustment-means that allows adjustment of rolling direction of the applicator-wheel 250 with respect to the travel direction 12 of the platform-components, when the escalator or moving walkway is in operation.

Figure 8A:
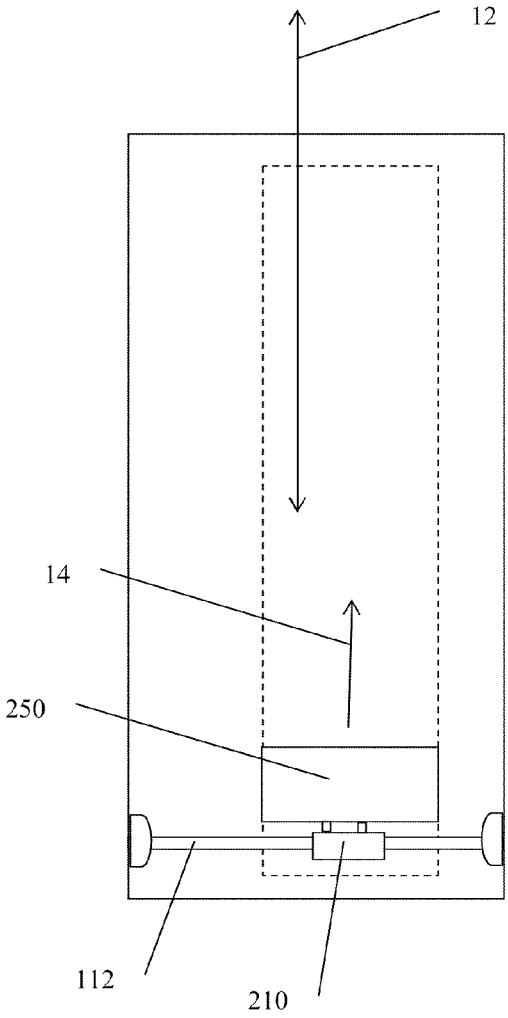
FIGS. 8A and 8B are schematic diagrams, with FIG. 8A showing the first embodiment with its applicator-wheel arranged facing directly forward, and with FIG. 8B showing the first embodiment with its applicator-wheel facing slightly at an angle.
Figure 8B:
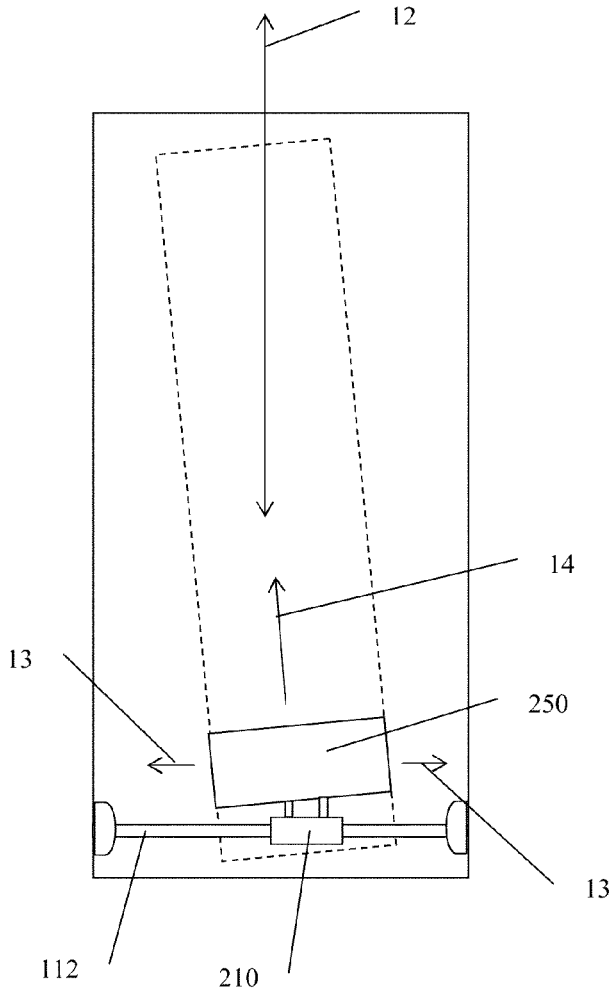

In FIGS. 8A and 8B, the "facing-direction" of the applicator-wheel 250 is defined as being the direction that is normal or perpendicular to the front-facing surface of the wheel-like portion of the applicator-wheel 250. For clarification, the facing-direction is indicated in FIGS. 7, 8A and 8B with an arrow 14.

Thus, FIG. 8A shows the applicator-wheel 250 arranged with its facing-direction arranged so as to be in line with the travel direction 12 of the platform-components.

In comparison, in FIG. 8B, the applicator-direction-adjustment-means has been used to adjust the applicator-wheel 250 to be arranged with its facing-direction at a slight angle with respect to the travel direction 12 of the platform-components. This enables the applicator-wheel 250 to move laterally, while at the same time rolling on the tread-plates. In FIG. 8B, the lateral movement is indicated by arrows 13. This enhances the ability to apply the material evenly onto the peaks of the tread-plates.

In the embodiment, the mechanism that controls the applicator-wheel 250 is also provided with an adjustment mechanism that allows the operator to alter the direction of lateral movement, either leftwards or rightwards. In the embodiment, when the lateral travel in one direction, for instance to the left, has caused the applicator-wheel 250 to reach the left hand side of the gap between the side-panels 11, the operator is then able to manually adjust the mechanism of the applicator-direction-adjustment-means to alter the direction of travel to cause it to move with a rightward lateral movement. This requires the operator to monitor the working of the material dispenser 100 constantly.

In the first embodiment of FIGS. 4, 5 and 6, the applicator-direction-adjustment-means is in the form of an adjustment mechanism having adjustable wing bolts 211, 212 that enable adjustment of the lengths of the two arms 213, 214 that connect the material-applicator 200 to the nearest strut 112.

In other modifications, a totally automated, and even a motorized system, can be provided to automatically switch between left and right movement.

In other modifications, the material dispenser 100 can be provided with electronic sensors to identify when the applicator-wheel 250 where it needs to switch to lateral movement in the opposite direction.

The lateral movement of the applicator-wheel 250 also facilitates the material 300 being gradually applied over the course of several passes of the applicator-wheel 250 rolling over the surfaces of the peaks 22.

The rate of lateral movement of the applicator-wheel 250, that would enhance the application of the material 300 to the peaks, in part depends on the speed of movement of the particular escalator or moving walkway. Hence, some experimentation by the operator, based on experience, may be needed to adjust the rate of lateral travel for optimum results.

In FIG. 8B, the angle of the front face has been exaggerated for the sake of illustration, however, in actual practice, the angle is usually quite slight, for example, 7 degrees off the direction of travel 12 of the platform components of the escalator, to ensure that the applicator-wheel 250 moves laterally at a gradual rate. The operator can vary the angle to accommodate any variations in other parameters of the process, such as the speed of the escalator or any variations in the consistency of the material 300.

Enhancing A Single Peak

Figure 9:
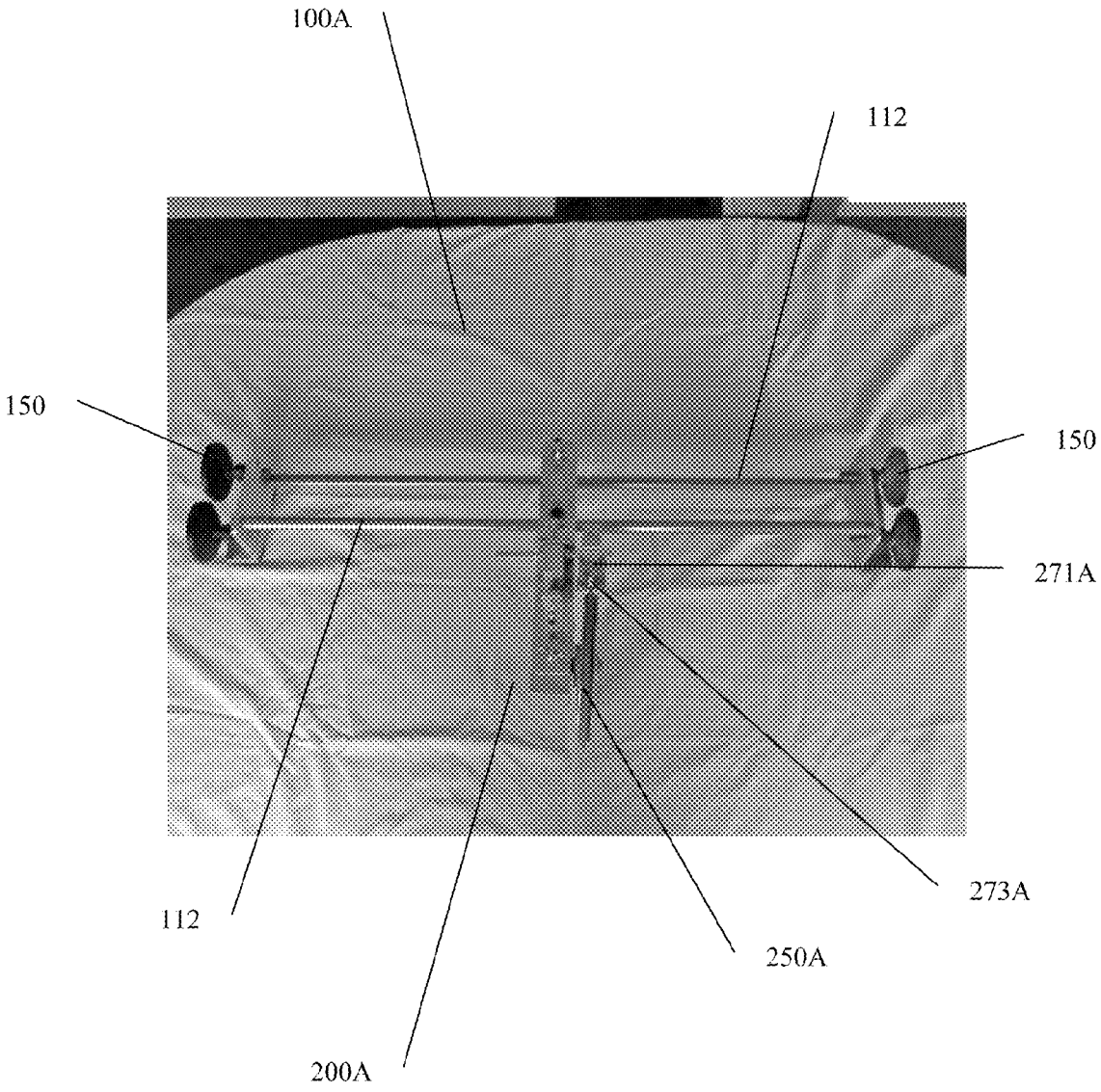
FIG. 9 shows a front-on perspective view of an enhancement apparatus according to a second embodiment of the present invention.
Figure 10:
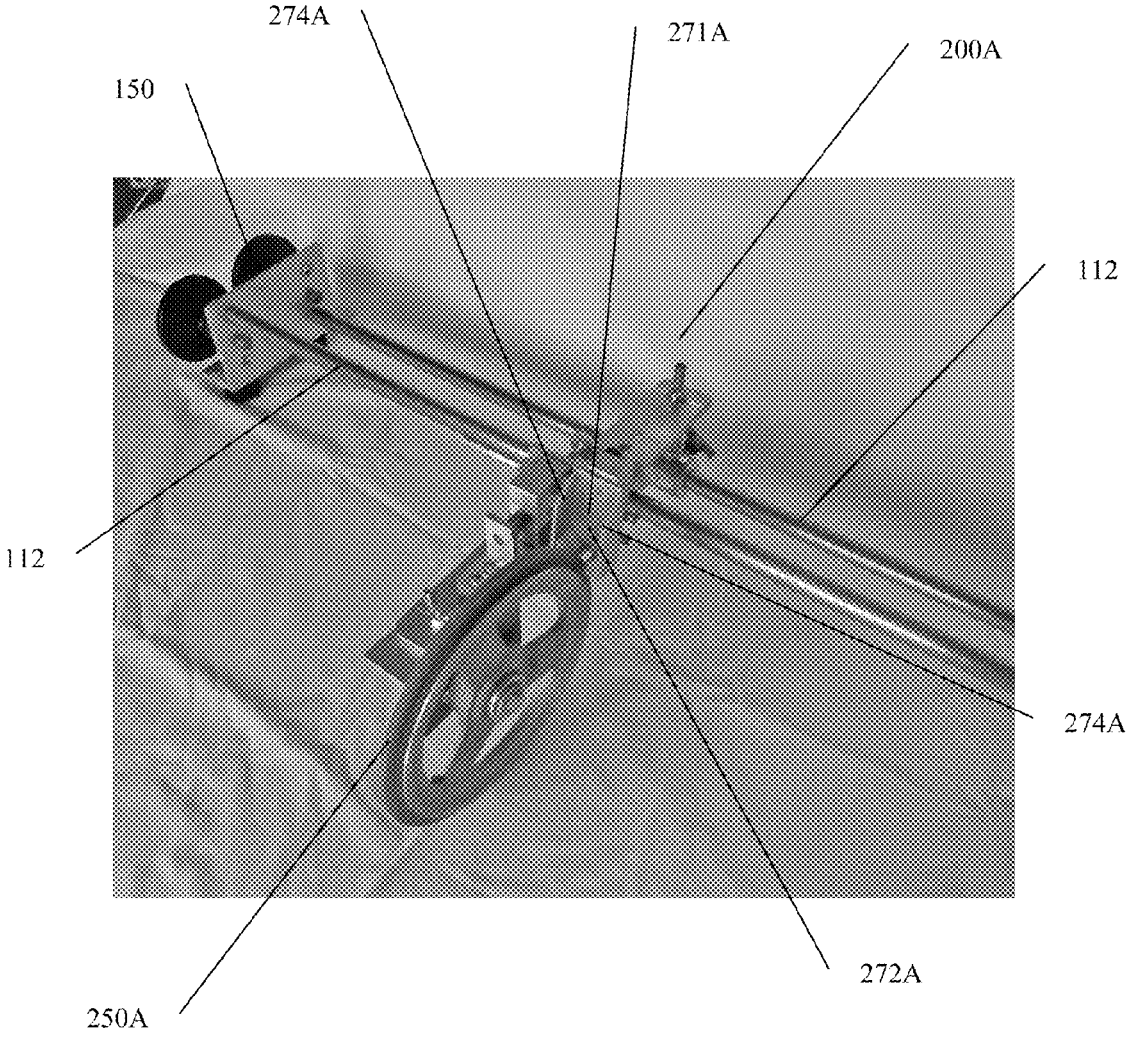
FIG. 10 shows another perspective view of the second embodiment of FIG. 9.

FIGS. 9 and 10 show a second embodiment of a modified material dispenser 100A.

The second embodiment of FIG. 9 differs from the earlier first embodiment in that, in this modification, the applicator-wheel 250A is significantly narrower, to the extent that it is narrow enough to apply flowable material 300 to a single peak of a conventional tread-plate 21 of an escalator or moving walkway.

In FIG. 10, the material dispenser 100A is provided with struts 112. The struts 112 and frame of the second embodiment can be the same as that used for the first embodiment.

Figure 11:
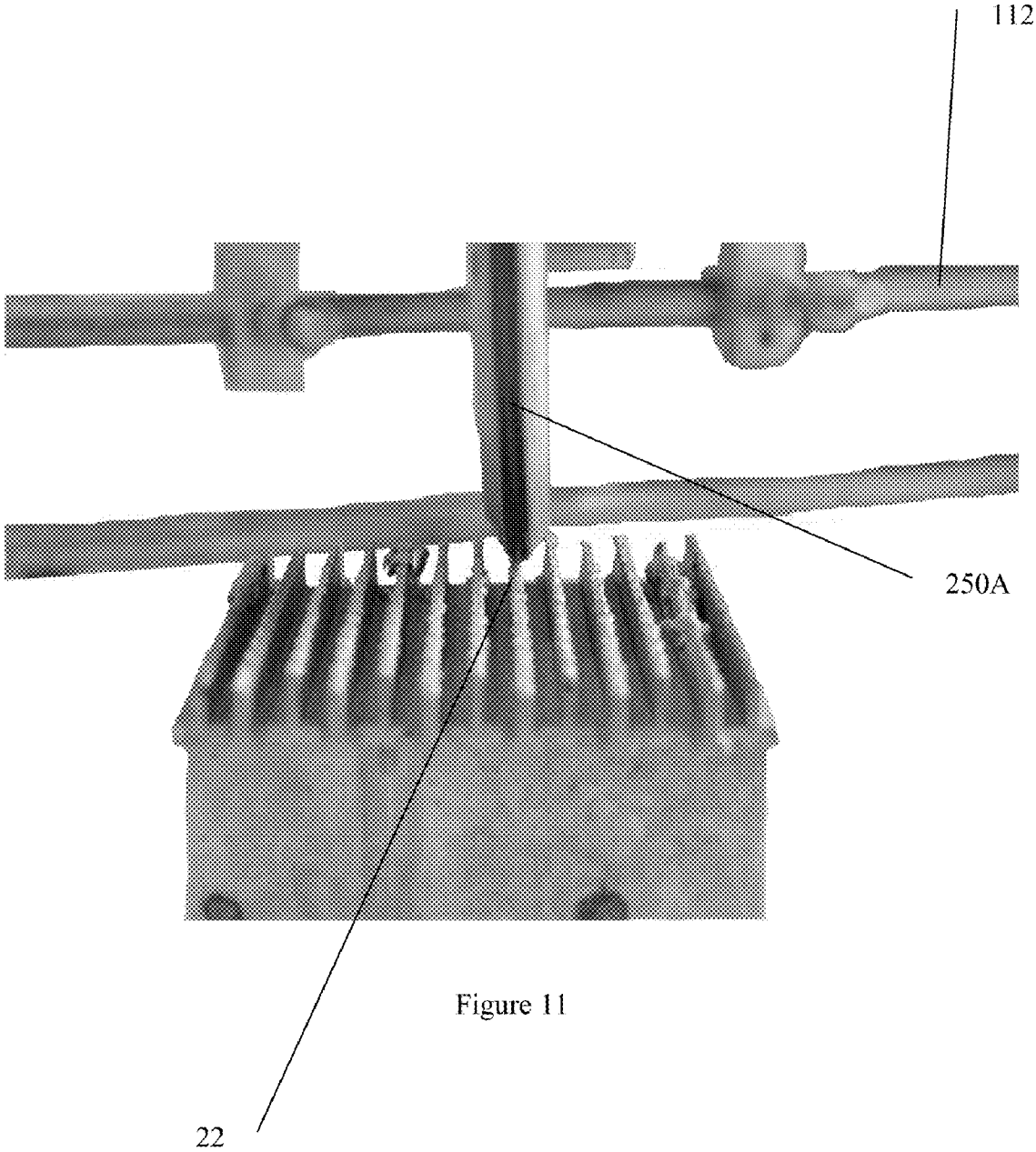
FIG. 11 shows a front view of part of the second embodiment shown in operation.

FIG. 11 shows that the material dispenser 100A of the second embodiment has an applicator 200A that is provided with a narrow applicator-wheel 250A. The width of the narrow wheel 250A is able to extend across merely one peak when it rolls on the tread-plates 21 of a platform-component 20.

In FIG. 11, the narrow wheel 250A has a rounded leading edge. In other modifications, the narrow wheel can have a flat leading edge.

In the embodiment of FIGS. 9 and 10, the material-transfer-rate-variation-means includes a small collection receptacle 272A.

In FIG. 10, the narrow collection receptacle 272A is provided by an arrangement of a small blade-portion 271A, bounded on either side by two side-members 274A which taper downwards in a V-shaped manner ending with outlet-means at its lowermost point.

In the embodiment of FIGS. 9 and 10, the outlet-means is part of the material-transfer-rate-variation-means. The outlet-means is in the form of a variable gap 273A. The size of the gap 273A is able to be varied by moving the small blade-portion 27 1A forwards or backwards. This has the effect of raising or lowering the small blade-portion 271A relative to the surface of the narrow applicator-wheel 250A. This allows the user to adjust the size of the gap 273A between the edge of the blade-portion 271A and the surface of the narrow applicator-wheel 250A.

The adjustability of the size of the gap 273A allows the user to control the amount of the flowable enhancement-material that flows from the receptacle, through the gap, and onto the rest of the rotatable applicator.

(The operation of the second embodiment is analogous to the operation of the first embodiment with reference to FIG. 7).

In the second embodiment of FIGS. 9, 10 and 11, the narrow, circular rim of the material dispenser 100A is required to roll accurately along a single elongate peak, which is typically about 1 millimeter wide, without departing either side of that peak. Hence, the material dispenser 100, during operation, is able to be maintained in accurate alignment relative to the single peak, as a result of a range of adjustment facilities that are part of the apparatus of the material dispenser 100A. These adjustment facilities include the adjustability of the swivel-pads 150, as well as the ability to adjust and fix the location of the applicator 200A anywhere along the span of the struts 112 in FIGS. 9 & 10.

In some scenarios, an embodiment of the process can be used to repair damage that has occurred to a single elongate peak, where such damage has also resulted in a bur or other imperfections in the form of projections from the surface of the peak. In such scenarios, before applying the material according to the above embodiments, there can be an initial preparatory step where a shaving-device can be used to shave off such projections. Such a shaving device can have a blade that is positioned to shave off the imperfections. The shaving device is able to be attached to the struts 112 of the frame, so that its blade can be held in alignment to shave off the projections, as the tread-plates pass under the enhancement apparatus.

Composition of the Enhancement-Material

In the embodiment, an exemplary enhancement-material is an epoxy resin.

The epoxy preferably contains a particulate material that is able to provide slip-resistance as a result of the hard particles.

Preferably, the enhancement-material is a metalized epoxy that contains metallic particles. The metallic particles, contained in the epoxy material, contribute to its coarse or rough texture which enhances the slip-resistance and wear-resistance of the surfaces on which people stand on the escalator or moving walkway.

Preferably, the epoxy compound is a two component system, comprising a resin and a solidifier, and also includes a metal aggregate. The epoxy material is able to cure at room temperature. In its pre-cure, flowable state, the epoxy material has the consistency of a paste-like adhesive. Once solidified, the epoxy has properties of high strength and toughness.

In the embodiment, the epoxy material is thixotropic with good environmental and chemical resistance. In the embodiment, the epoxy resin is based on Bisphenol A. The solidifier is based on Benzyl Alchol, Diethylenetriamine, Cycloaliphatic Amine Mixture, Isophorone Diamine and 4,4'-Isoproplylidenediphenol. When the two materials are blended, for instance, with a spatula, they form a homogeneous mix which is deposited onto the tread-plates using the material-applicator 200 of the material dispenser 100, as described herein.

The material used in the embodiment cures to a solid form in around one hour, and is fully cured within around 8 hours at 20 degrees Centigrade. This curing timeframe enables the material to be applied in situ to the surfaces of existing escalator, for example, in a shopping centre just after closing time, say, at 10 p.m. This would leave sufficient time for the material to be applied and fully cured in time for opening of the shopping centre at 9 a.m. in the morning, thus avoiding the inconvenience of downtime.

In the embodiment, the aggregate material consists of Aluminum particles or an Based-based particulate material. In other variations, different materials can be used to provide enhanced wear resistance. The particles may be synthetic or mineral-based. In other modifications, the particulate material can be of any appropriate material, such as quartz or polypropylene particles, provided such material can provide adequate wear and slip resistance when incorporated with the epoxy resin.

In the embodiment, the epoxy material 300 is formulated so as to have a pre-cure viscosity that, in use, flows neither too quickly nor too slowly for the purpose of being applied by embodiments of the enhancement apparatus.

In some embodiments, the enhancement-material is applied without any particulate material, for example, when applying enhancement material to a single peak on an existing tread-plate in which the other peaks do not have a particulate-like surface structure.

Shaping

As mentioned, the enhancement material 300 used in the embodiment has a curing time of around one hour before the material solidifies. In this curing period, the material 300 proceeds from an initial flowable state into a solid, cured state.

This curing period provides a window of opportunity where the operator, if desired, is able to further shape the material after it has been transferred to the peak or peaks of the tread-plates. In other variations of the method, this may be achieved by running a mould over the material 300 that has been applied to the peaks while the material is still in a pliable state.

The mould consists of a mould-member that has a cross-sectional shape that complements the desired shape of the peak. Thus, for example, if the material that is applied to the peak is desired to have a rectangular profile, then the mould-member would have a cross-sectional, cut-out area that has a complementary rectangular shape.

The mould-member is able to be attached to the struts 112 of the frame, so that it can be held in alignment with the peaks, and to shape the peaks, as the tread-plates pass under the enhancement apparatus.

Advantage of the Process & Device

The embodiments are able to produce a constant, even coating on the peaks of the tread-plates in terms of coverage and profile.

The ability to achieve evenness of coating is at least attributed to the ability to apply the material 300 at a constant rate. In the embodiment, this is a result of the applicator-wheel 250, 250A rolling at a constant rate of rotation, as it rolls on the moving tread-plates of the escalator or walkway, which are themselves kept at a constant operational speed as it operates in situ.

The cost of operating the embodiment of FIG. 4, in situ, to enhance the tread-plates of an escalator is likely to be less expensive that the alternative cost of disassembling the escalator, removing the parts to an off-site workshop, and relying on an expensive enhancement process such as arc-spraying. In addition to lowering costs, a considerable advantage of performing an enhancement process in situ, without having to disassemble and remove parts of the escalator, is that it avoids the disruption that would occur from not having the escalator in operation for long periods of time. Also, the enhancement process is able to repair existing components of escalators, thus avoiding or postponing the higher expense of replacing these components.

Other Variations

In other modifications, there are other ways of maintaining the enhancement apparatus in a constant position relative to the escalator, which may be achieved by fastening the apparatus to other parts of the escalator environment that are not moving.

In the first and second embodiments, the enhancement apparatus is held firmly between the upright, non-moving sides 11 of the escalator. The functional requirement, however, is that the enhancement apparatus is maintained in a constant position relative to the moving platform components 20, hence, this could conceivably be achieved by a mechanism that holds the enhancement apparatus to another object or surface that is not moving, for instance, to the ground surface.

In another alternative, the position-maintenance-means could simply comprise a heavy, non-moving mass that has sufficient mass, in itself, to act as ballast to maintain the enhancement apparatus in a constant location relative to the moving platform components. In other words, the invention in its broadest aspect is not limited to only having the enhancement apparatus held fast directly in contact with the upright sides 11.

The visual appearance of the frame of various parts of the enhancement apparatus can be varied while maintaining similar mechanical and functional capabilities of the invention in its broadest aspect. For example, the frame of struts 112 and end-panels 111 can be replaced by a support device in the form of a solid box that can carry the various the material dispensers 100, 100A, and where the material dispensers 100 move along the box controlled by a track with rack and pinion gears.

In another conceivable modification, the applicator-means includes an phalanx of nozzles, one for each elongate peak. Each nozzle is connected to a reservoir that contains the enhancement-material. As the tread-plates move continuously under such an applicator-means, the material is applied to the peaks in a manner analogous to toothpaste coming out of the nozzle of its tube.

In this specification, the words enhance, enhancing, enhanced and other variants, include: adding material to the peaks of the standing-surface of the platform-components, either for improving its existing surface characteristics, or for repair-enhancement of surfaces that have previously been damaged.

In this specification, the reference to the escalator or moving walkway being in operation, in situ, means that the enhancement process is performed where the escalator or walkway actually is, without taking any of its components away for enhancement off-site. For example, if the escalator is located in a shopping centre, then the enhancement process, in situ, is carried out in the shopping centre, without the need to disassemble parts of the escalator to take them away for off-site repair.

The embodiments have been advanced by way of example only, and modifications are possible within the scope of the invention as defined by the appended claims.

In this specification, where the words comprise or comprises or derivatives thereof are used in relation to elements, integers, steps or features, this is to indicate that those elements, steps or features are present but it is not to be taken to preclude the possibility of other elements, integers, steps or features being present.

The specification and its appended claims specifically exclude from its scope any matter that does not pertain to the field of escalators and moving walkways.

The invention claimed is:

1. A method of enhancing standing-surfaces of platform-components of an escalator or a moving walkway which, in operation, is able to move in a continuous loop of a plurality of mutually connected platform-components, and in which the standing-surface of each platform-component has an alternating series of elongate, parallel valleys and peaks that generally align axially with the travel direction of the platform-components, the method comprising:

using position-maintenance-means of an enhancement apparatus to maintain the enhancement apparatus in a constant position relative to the escalator or moving walkway such that all the standing-surfaces of the platform-components are able to pass under the enhancement apparatus one followed by another as a result of movement of the continuous loop of the mutually connected platform-components; and using applicator-means of the enhancement apparatus, when the escalator or moving walkway is in operation in situ, to apply a flowable enhancement-material to one or more peaks of the standing-surfaces of the moving platform-components at which location on the one or more peaks the flowable enhancement-material solidifies in order to enhance surface characteristics of the peaks of the standing-surfaces.

2. A method of claim 1 wherein the method includes:

using the applicator-means to feed the flowable enhancement-material onto a rotatable applicator when the applicator is rolling, so that at least a part of the applicator is coated with the enhancement-material; and, while the escalator or moving walkway is in operation, allowing the rotatable applicator to roll on the standing-surfaces as the standing-surfaces pass under the enhancement apparatus one followed by another, such that the flowable enhancement-material on the rotatable applicator is applied by transference to the one or more peaks.

3. A method of claim 2 wherein the method includes:

feeding the flowable enhancement-material into a collection receptacle having outlet-means which leads onto the rotatable applicator.

4. A method of claim 1 wherein the flowable enhancement-material comprises an epoxy resin.

5. A method of claim 4 wherein the epoxy resin is based on Bisphenol A.

6. A method of claim 4 wherein the epoxy resin uses a solidifier based on Benzyl Alchol, Diethylenetriamine, Cycloaliphatic Amine Mixture, Isophorone Diamine and 4,4'-Isoproplylidenediphenol.

7. A method of claim 1 wherein the flowable enhancement-material includes a particulate material that is able to provide slip-resistance.

8. A method of claim 7 wherein the particulate material contains metallic, synthetic or mineral-based particles.

9. A method of claim 7 where the particulate material includes Aluminum particles, or an Based-based particulate material, or quartz particles, or polypropylene particles.

10. An enhancement apparatus adapted to enhance standing-surfaces of platform-components of an escalator or a moving walkway which, in operation, is able to move in a continuous loop of a plurality of mutually connected platform-components, and in which the standing-surface of each platform-component has an alternating series of elongate, parallel valleys and peaks that generally align axially with the travel direction of the platform-components, wherein the apparatus comprises:

position-maintenance-means adapted to maintain the enhancement apparatus in a constant position relative to the escalator or moving walkway such that, in use, all the standing-surfaces of the platform-components are able to pass under the enhancement apparatus one followed by another as a result of movement of the continuous loop of the mutually connected platform-components; and applicator-means adapted to apply a flowable enhancement-material, when the escalator or moving walkway is in operation in situ, to one or more peaks of the standing-surfaces of the moving platform-components at which location on the one or more peaks the flowable enhancement-material solidifies in order to enhance surface characteristics of the peaks of the standing-surfaces.

11. An apparatus of claim 10 wherein the applicator-means comprises a rotatable applicator which is adapted to receive the flowable enhancement-material thereon when rolling so that at least a part of the applicator is coated with the material;

and which rotatable applicator is arranged to roll on the standing-surfaces as the standing-surfaces pass under the enhancement apparatus one followed by another, when the escalator or moving walkway is in operation, such that the flowable enhancement-material on the rotatable applicator is applied by transference to the one or more peaks.

12. An apparatus of claim 11 wherein the rotatable applicator comprises a wheel-like portion that has an outer rolling-surface which is adapted to receive the flowable enhancement-material thereon, and wherein the wheel-like portion has a width which, when rolling on the standing-surfaces of a platform-component, is able to extend across one or more peaks.

13. An apparatus of claim 12 wherein the applicator-means is adapted to apply the flowable enhancement-material, when the escalator or moving walkway is in operation in situ, to a plurality of the peaks of the standing-surfaces, and wherein the enhancement apparatus includes applicator-direction-adjustment-means that allows adjustment of rolling direction of the rotatable applicator with respect to the travel direction of the platform-components, when the escalator or moving walkway is in operation, and wherein the applicator-direction-adjustment-means allows adjustment to enable the rotatable applicator to be arranged so that its facing-direction is at a slight angle with respect to the travel direction of the platform-components to enable the rotatable applicator to move laterally while at the same time rolling on the standing-surfaces.

14. An apparatus of claim 10 wherein the applicator-means includes material-transfer-variation-means that enables the rate or amount of transference of the flowable enhancement-material by the applicator-means to be selectively varied.

15. An apparatus of claim 14 wherein the material-transfer-variation-means includes a collection receptacle which is adapted to receive the flowable enhancement-material therein, and which includes outlet-means through which an amount of the flowable enhancement-material in the collection receptacle is able to flow therefrom to the peaks via the rotatable applicator.

16. An apparatus of claim 15 wherein the outlet-means is provided with variable-outlet-means to allow adjustment of the amount of the flowable enhancement-material that flows from the receptacle onto the rotatable applicator.

* * * * *